United States Patent [19]

Nakamura et al.

[11] 3,984,247

[45] Oct. 5, 1976

[54] DYE-CONTAINING SILVER HALIDE PHOTOGRAPHIC LIGHT-SENSITIVE MATERIAL

[75] Inventors: Yasurharu Nakamura; Masatoshi Sugiyama; Hiroshi Sawaguchi; Teturo Nagata; Shinzo Kobayashi; Tohru Sueyoshi, all of Minami-ashigara, Japan

[73] Assignee: Fuji Photo Film Co., Ltd., Minami-ashigara, Japan

[22] Filed: July 17, 1975

[21] Appl. No.: 596,797

[30] Foreign Application Priority Data

July 17, 1974 Japan ..... 49-82517

[52] U.S. Cl. ..... 96/84 R

[51] Int. Cl.[2] ..... G03C 1/84

[58] Field of Search ..... 96/84 R, 129, 140

[56] References Cited

UNITED STATES PATENTS

| | | | |
|---|---|---|---|
| 3,647,460 | 3/1972 | Hofman | 96/84 R |
| 3,865,817 | 2/1975 | Kobayashi et al. | 96/84 R |
| 3,928,856 | 12/1975 | Nakazawa et al. | 96/129 |

*Primary Examiner*—Jack P. Brammer
*Attorney, Agent, or Firm*—Sughrue, Rothwell, Mion, Zinn and Macpeak

[57] ABSTRACT

A photographic light-sensitive material comprising at least one hydrophilic colloid layer containing at least one dye represented by the following formula (I):

(I)

wherein $R^1$ represents an alkyl group, a carboxy group, an alkoxycarbonyl group, a carbamoyl group, an alkylcarbamoyl group, a sulfamoyl group, an alkylsulfamoyl group, an acyl group, a hydroxy group, an alkoxy group, an alkylthio group, an amino group, a ureido group, an alkylureido group, a thioureido group or an alkylthioureido group; Q represents a sulfoalkyl group, a sulfoalkoxyalkyl group or a sulfoalkylthioalkyl group; L represents a methine group; *n* is 0 or 1; $R^2$ represents $-OR^5$ or wherein $R^5$, $R^6$ and $R^7$ each represents a hydrogen atom or an alkyl group; $R^3$ represents a hydroxy group, an alkoxy group or an alkyl group; and $R^4$ represents a hydrogen atom, an alkyl group, an alkoxy group, a sulfoalkoxy group, an alkylamino group or a dialkylamino group.

10 Claims, No Drawings

DYE-CONTAINING SILVER HALIDE PHOTOGRAPHIC LIGHT-SENSITIVE MATERIAL

BACKGROUND OF THE INVENTION

1. Field of the Invention

The present invention relates to a photographic light-sensitive material having at least one dyed hydrophilic colloid layer, and more particularly, to a silver halide photographic light-sensitive material having at least one hydrophilic colloid layer containing one or more dyes which are readily decolored or removed during a photographic processing.

2. Description of the Prior Art

In the field of silver halide photographic light-sensitive materials, it is a common practice to color one or more layers, including a silver halide emulsion layer or silver halide emulsion layers, for the purpose of absorbing light of a certain wavelength region.

Where the spectral composition of light which falls upon a silver halide emulsion layer or silver halide emulsion layers must be controlled, a colored layer is usually employed in the photographic light-sensitive material, which layer being positioned farther from the support than the silver halide emulsion layer. Such a layer is called a filter layer. In cases of photographic materials having a plurality of photographic emulsion layers such as multi-layer color photographic materials, the filter layer can be positioned between two emulsion layers.

Where it is desired to prevent the image from becoming indistinct (or halation) caused by light which is scattered during or after the transmission of the light through a photographic emulsion layer or layers, reflected on the interface between the support and an emulsion layer or on the surface of the photographic light-sensitive material opposite the emulsion layer or layers, and passes again through the emulsion layer or layers, a colored layer can be arranged between the support and an emulsion layer or on the surface of the support opposite the emulsion layer or layers. Such a colored layer is called an antihalation layer. With photographic light-sensitive materials having a plurality of emulsion layers (such as multi-layer color photographic materials), such a colored layer can be positioned on occasion between two emulsion layers.

In order to prevent a reduction in the sharpness of the image due to the diffusion of light in an emulsion layer (which is generally referred to as irradiation), the photographic layers can also be colored.

Most of these colored layers are composed of a hydrophilic colloid and hence one or more hydrophilic dyes are usually incorporated therein in order to color these layers. The dyes employed for these purposes, in addition to having an appropriate color absorption adequate for their use, must satisfy the following requirements:

1. The dyes must be photochemically inert, that is, they must not exert any photochemically adverse effects, e.g., a reduction in sensitivity, a regression of latent images or fogging, upon the properties of the emulsion layers.

2. The dyes must be either decolored during photographic processing or dissolved into a processing solution or a wash solution, so that the dyes leave no stain in the photographic light-sensitive materials after processing.

Many efforts have been made by those skilled in the art to discover dyes that meet these requirements. Dyes previously proposed have included, for example, oxonol dyes with a pyrazolone nucleus represented by those described in British Pat. No. 506,385; oxonol dyes with a barbituric acid nucleus represented by those described in U.S. Pat. No. 3,247,127; other oxonol dyes as described, for example, in U.S. Pat. Nos. 2,533,472 and 3,379,533 and British Pat. No. 1,278,621; hemi-oxonol dyes represented by those described in British Pat. No. 584,609; styryl dyes represented by those described in U.S. Pat. No. 2,298,733; merocyanine dyes represented by those described in U.S. Pat. No. 2,493,747; cyanine dyes represented by those described in U.S. Pat. No. 2,843,486; and the like.

Of these previously known dyes, benzylidene- or cinnamylidene-pyrazolone dyes represented by those described in British Pat. No. 584,609 have been widely used as useful dyes since they absorb light in a relatively broad wavelength region of the spectrum, can be readily decolored in a processing solution containing sulfite, and only slightly chemically influence the photographic properties of the photographic emulsions. In addition to those dyes described in British Pat. No. 584,609, a number of dyes of this series for use in a filter layer or an antihalation layer of photographic light-sensitive materials have been proposed in, for example, British Pat. Nos. 1,120,294 and 1,142,697; U.S. Pat. Nos. 3,316,091, 3,540,887, 3,544,325 and 3,615,546, and the like.

However, when paper is used as a support of a photographic light-sensitive material, these known dyes are absorbed on the paper support and are not removed by washing although they can be decolored in a photographic processing solution containing sulfite, so that they remain in the photographic material without being removed during the washing step and their color appears again along with a reduction in the concentration of the sulfite in the paper support. In particular, where a number of photographic papers are processed in a definite amount of a photographic processing solution, the dyes accumulate in the solution in a decolored state so that they are retained in the paper support and produce color stain in the washing step.

SUMMARY OF THE INVENTION

Therefore, an object of this invention is to provide silver halide photographic light-sensitive materials containing, in an hydrophilic colloid layer or layers, a dye which does not leave any stain after photographic processing even when larger quantities of photographic materials are processed per unit volume of photographic processing solution.

Another object of this invention is to provide photographic printing papers containing, in a hydrophilic colloid layer or layers, a dye which does not leave any stain after photographic processing even when larger quantities of photographic materials are processed per unit volume of the photographic processing solution.

Still another object of the invention is to provide silver halide photographic light-sensitive materials containing, in an emulsion layer or layers, a stable dye of which no colored residue remains after photographic processing.

These and other objects of the invention are accomplished by incorporating into a hydrophilic colloid layer or layers, including a light-sensitive silver halide emulsion layer or layers and/or a light-insensitive hydrophilic colloid layer or layers, of the photographic light-sensitive materials at least one water-soluble dye represented by the following general formula (I):

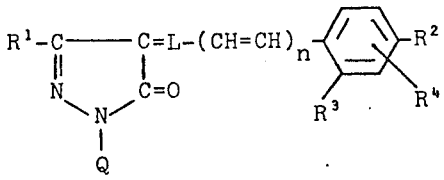

(I)

wherein R′ represents an alkyl group, a carboxy group, an alkoxycarbonyl group, a carbamoyl group, an alkylcarbamoyl group, a sulfamoyl group, an alkylsulfamoyl group, an acyl group, a hydroxy group, an alkoxy group, an alkylthio group, an amino group, a ureido group, an alkylureido group, a thioureido group or an alkylthioureido group; Q represents a sulfoalkyl group, a sulfoalkoxyalkyl group or a sulfoalkylthioalkyl group; L represents a methine group; $n$ is 0 or 1; $R^2$ represents an $—OR^5$ group or an

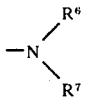

group wherein $R^5$, $R^6$ and $R^7$ each represents a hydrogen atom or an alkyl group; $R^3$ represents a hydroxy group, an alkoxy group or an alkyl group; and $R^4$ represents a hydrogen atom, an alkyl group, an alkoxy group, a sulfoalkoxy group, an alkylamino grup or a dialkylamino group.

DETAILED DESCRIPTION OF THE INVENTION

In the above general formula (I):

$R^1$ represnts an alkyl group containing up to 6 carbon atoms, which may be straight chain, branched chain or cyclic (e.g., methyl, ethyl or butyl); a carboxy group; an alkoxycarbonyl group containing up to 5 carbon atoms (e.g., ethoxycarbonyl or butoxycarbonyl); a carbamoyl group; an alkylcarbamoyl group containing up to 5 carbon atoms (e.g., ethylcarbamoyl, butylcarbamoyl, dimethylcarbamoyl, etc.); a sulfamoyl group; an alkylsulfamoyl group containing up to 4 carbon atoms (e.g., ethylsulfamoyl or butylsulfamoyl); an acyl group containing an alkyl group with 1 to 5 carbon atoms (e.g., an alkylcarbonyl group (such as acetyl, valeryl, pivaloyl, etc.), or an alkylsulfonyl group (such as methylsulfonyl, butylsulfonyl, etc.)); a substituted acyl group (such as an alkylcarbonyl group or an alkylsulfonyl group substituted with, for example, a halogen atom (e.g., chlorine or bromine) or a cyano group); a hydroxy group; an alkoxy group containing 1 to 5 carbon atoms (e.g., methoxy, ethoxy, butoxy, etc.); an alkylthio group containing 1 to 5 carbon atoms (e.g., methylthio, butylthio, etc.); an amino group; a substituted amino group (such as an alkylamino group containing up to 5 carbon atoms (e.g., ethylamino or butylamino), a dialkylamino group containing up to 8 total carbon atoms (e.g., dimethylamino, diisopropylamino, etc.), or an acylamino group containing an alkyl group having up to 4 carbon atoms (e.g., acetylamino, pivaloylamino, ethylsulfonylamino, etc.)); an ureido group; an alkylureido group containing an alkyl group having up to 4 carbon atoms (e.g., methylureido or butylureido); a thioureido group; an alkylthioureido group containing an alkyl group having up to 4 carbon atoms (e.g., methylthioureido, butylthioureido, etc.); and the like;

Q represents a sulfoalkyl group containing up to 6 carbon atoms (e.g., sulfoethyl, 3-sulfopropyl, 4-sulfobutyl, 3-sulfobutyl, etc.), a sulfoalkoxyalkyl group (e.g., 2-(β-sulfoethoxy)ethyl, 3-(sulfomethoxy)propyl, etc.) or a sulfoalkylthioalkyl group containing up to 6 carbon atoms (e.g., 3-(sulfomethylthio)propyl, etc.), in which these residues may have another substituent other than a sulfo group, such as a halogen atom (e.g., chlorine or bromine), a hydroxy group, and an alkoxy group containing from 1 to 4 carbon atoms (e.g., methoxy, propoxy, n-butoxy, etc.);

L represents a methine group or a methine group substituted with an alkyl group containing up to 4 carbon atoms (such as methyl or ethyl);

$n$ represents an integer of 0 or 1;

$R^2$ represents $—OR^5$ or

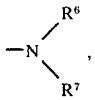

wherein $R^5$ represents a hydrogen atom, an alkyl group containing up to 6 carbon atoms (e.g., methyl, isopropyl, butyl, etc.), or a substituted alkyl group substituted with one or more of a cyano group, a sulfo group, a carboxy group, a halogen atom (e.g., chlorine or bromine), a hydroxy group, an alkoxycarbonyl group containing up to 5 carbon atoms (e.g., ethoxycarbonyl), an alkylcarbonyloxy group containing an alkyl group with up to 4 carbon atoms (e.g., acetoxy), an alkylsulfonyloxy group containing an alkyl group with up to 5 carbon atoms (e.g., ethylsulfonyloxy), an alkylcarbonyl group containing an alkyl group with up to 5 carbon atoms (e.g., acetyl or propionyl), an alkylsulfonyl group containing an alkyl group with up to 5 carbon atoms (e.g., ethylsulfonyl or butylsulfonyl), an alkoxy group containing up to 5 carbon atoms (e.g., methoxy or butoxy), an alkylthio group containing up to 5 carbon atoms (e.g., methylthio, ethylthio, n-butylthio, etc.), and the like, and $R^6$ and $R^7$ each represents the same substituents as described for $R^5$ or a substituted alkyl group containing one or more of an amino group, an alkylamino group having up to 5 carbon atoms (e.g., ethylamino, butylamino, etc.), a dialkylamino group having up to 5 carbon atoms (e.g., dimethylamino or diethylamino), an alkylcarbonylamino group containing an alkyl group having up to 4 carbon atoms (e.g., acetylamino or pivaloylamino) and an alkylsulfonylamino group (e.g., ethylsulfonylamino) as substituents;

$R^3$ represents a hydroxy group, an alkoxy group containing up to 4 carbon atoms (e.g., methoxy, ethoxy, butoxy, etc.), or an alkyl group containing up to 4 carbon atoms (e.g., methyl, ethyl, butyl, etc.); and $R^4$ represents a hydrogen atom, an alkyl group containing up to 4 carbon atoms (e.g., methyl, ethyl, butyl, etc.), an alkoxy group containing up to 4 carbon atoms (e.g., methoxy, ethoxy, butoxy, etc.), a sulfoalkoxy group containing up to 4 carbon atoms (e.g., γ-sulfopropoxy, etc.), an alkylamino group containing up to 4 carbon atoms (e.g., ethylamino or butylamino), or a dialkylamino group (e.g., dimethylamino or diisopropylamino).

The above-described carboxy groups, sulfo groups and sulfo moieties of the sulfoalkyl, sulfoalkoxy, sulfoalkoxyalkyl and sulfoalkylthioalkyl groups for $R^1$, $R^2$, $R^4$ and Q can exist in a free form or as a salt thereof with an alkali metal (e.g., sodium, potassium, lithium, etc.), an alkaline earth metal (e.g., magnesium, calcium, strontium, etc.), ammonia or an organic base (e.g., triethylamine, pyridine, morpholine, etc.).

In the above general formula (I), $R^1$ is preferably an alkyl group, a carboxy group, an alkoxycarbonyl group, an alkylcarbamoyl group, a hydroxy group, an alkoxy group, an acylamino group or an alkylureido group; Q is preferably a sulfoalkyl group; L is preferably an unsubstituted methine group; $R^2$ is preferably a hydroxy group, an alkoxy group, a sulfoalkoxy group, an amino group, a dialkylamino group, an N-sulfoalkyl-N-alkylamino group, a di(sulfoalkyl)amino group or an N-(alkylsulfonylaminoalkyl)-N-alkylamino group (with an alkoxy group, a sulfoalkoxy group, a dialkylamino group or an N-sulfoalkyl-N-alkylamino group being particularly preferred); $R^3$ is preferably a hydroxy group, a methoxy group or a methyl group; and $R^4$ is preferably a hydrogen atom, a methyl group or a methoxy group.

Typical dyes represented by general formula (I) used in this invention are illustrated below but this invention is not to be construed as being limited to these dyes only.

1

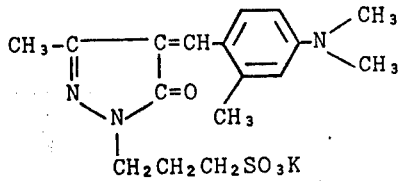

2

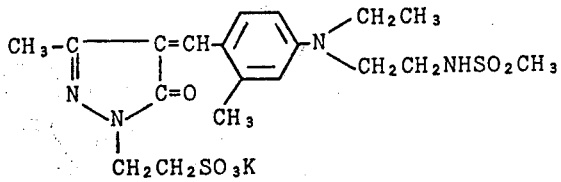

3

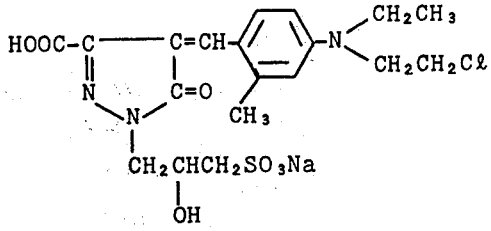

4

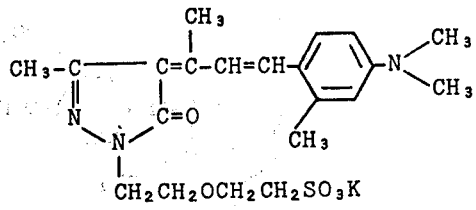

5
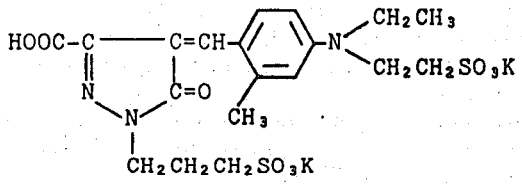
6
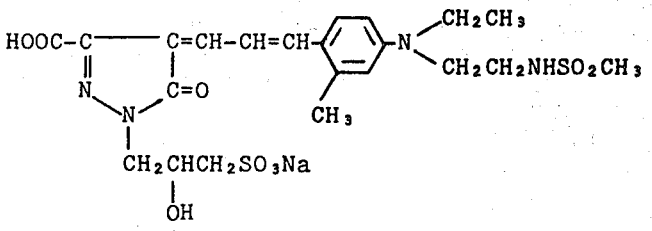
7
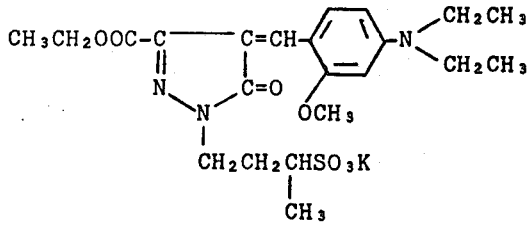
8
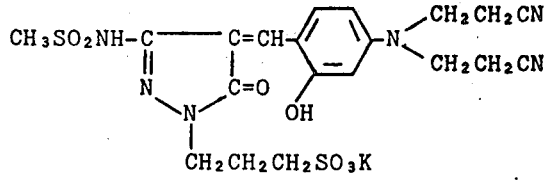
9
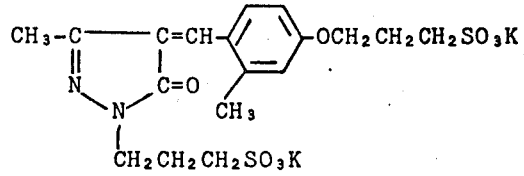
10
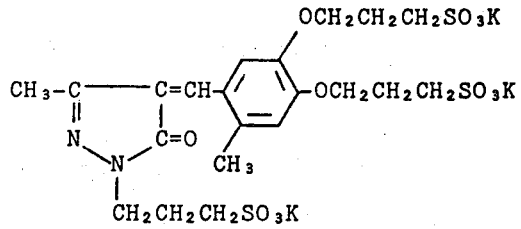

11

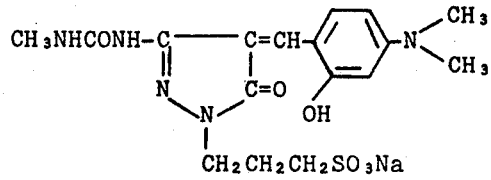

12

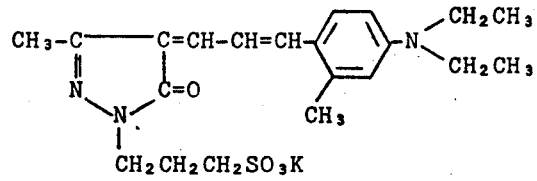

13

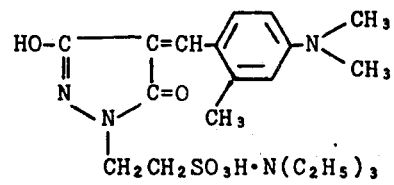

14

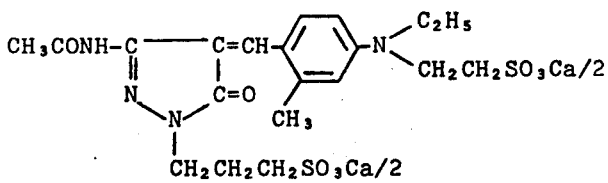

The dyes represented by general formula (I) can be prepared by the following methods.

The dyes of the general formula (I) can be synthesized by condensing an aldehyde represented by the following general formula (II):

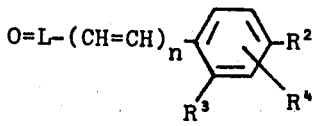

(II)

wherein $R^2$, $R^3$, $R^4$, $n$ and L each has the same meanings as in general formula (I), with a pyrazolone derivative represented by the following general formula (III):

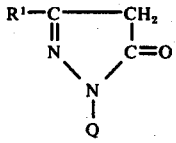

(III)

wherein $R^1$ and Q each has the same meanings as in general formula (I). The starting aldehydes of the general formula (II) where $n$ is 1 can be prepared employing the procedures described in *Chem. Ber.*, 91, 850 (1958) and *Ber.*, 61, 2074 (1928) and the starting pyrazolone derivatives of the general formula (III) can be prepared according to the disclosure contained in U.S. Pat. No. 2,265,221 and *Veroff. wiss. Photo-Lab. Agfa*, 10, 277 (1965).

In the case of dyes of the general formula (I) in which $n = 1$, these dyes can also be synthesized by the condensation of an aldehyde compound of the following general formula (IV):

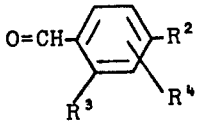

(IV)

wherein $R^2$, $R^3$and $R^4$ each has the same meanings as defined above, with a pyrazolone derivative of the following general formula (V):

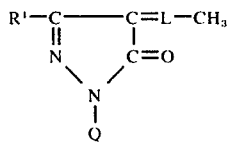

(V)

wherein R', L, and Q each has the same meanings as defined above. The starting aldehydes of the formula (IV) can be prepared according to the disclosure in *Ber.*, 60, 119 (1927) and British Pat. No. 456,534 and the starting pyrazolones of the formula (V) can be prepared according to the disclosure in *Ber.*, 66, 727 (1933).

The condensation reaction can be advantageously carried out by use of a solvent capable of dissolving the starting materials. Examples of suitable solvents which can be used include alcohols (e.g., methanol, ethanol, isopropanol, etc.), ethylene glycol monoalkyl ethers (e.g., ethylene glycol monomethyl ether, etc.), amides (e.g., acetamide, dimethylformamide, etc.), ethers (e.g., dioxane, etc.), dimethyl sulfoxide, chloroform, carboxylic acids (e.g., formic acid, oxalic acid, acetic acid, etc.), and the like. These solvents can be used either individually or in combination. The reaction can be preferably carried out in the range of from about room temperature (about 20° – 30° C) to the boiling point of the solvent used. In order to promote the reaction, a base such as pyridine, piperidine, diethylamine, triethylamine, gaseous ammonia, potassium acetate, and the like can be advantageously added to the reaction system, e.g., preferably in an amount of about 0.1 to 3.0 moles per mole of the pyrazolone derivative, however, such is not required. In some instances, bases such as pyridine can be used as both a solvent and a base. A suitable reaction time is ordinarily about 10 minutes to about 5 hours. The aldehyde compounds represented by the general formula (II) or (IV) and the pyrazolone derivatives represented by the general formula (III) or (V) are preferably reacted in a molar ratio of about 1:1 to about 3:1.

Examples of the preparation of the dyes of the general formula (I) used in this invention are given below. Unless otherwise indicated herein, all parts, percents, ratios and the like are by weight.

PREPARATION EXAMPLE 1

(Dye No. 1)

Into a solution of 14 ml of triethylamine and 100 ml of isopropanol was dissolved 22 g of 3-methyl-1-sulfopropyl-5-pyrazolone, and 33 g of 4-dimethylamino-2-methylbenzaldehyde and 6 ml of acetic acid were added to the solution. After the solution was stirred for 3 hours at 80° to 85° C, a solution of 9.8 g of potassium acetate in 80 ml of methanol was added, and then the heating and stirring were continued for another 30 minutes. Upon cooling, a precipitate was deposited, which made it impossible to stir the resulting mixture. To this mixture additional methanol was added, and the resulting mixture was recrystallized to obtain 15 g of orange-colored crystals.

An aqueous solution of the dye obtained had an orange-yellow color, and showed an absorption maximum at 501 mμ.

PREPARATION EXAMPLE 2

(Dye No. 2)

Into a solution of 17 ml of triethylamine in 70 ml of methanol was dissolved 22 g of 3-methyl-1-sulfoethyl-5-pyrazolone, a solution of 29 g of 4-(N-ethyl-N-methylsulfonyl-aminoethyl)amino-2-methyl-benzaldehyde in 50 ml of methanol and 15 ml of acetic acid was added, and then the resulting mixture was heated under reflux for 2.5 hours with stirring. After a solution of 9.8 g of potassium acetate in 80 ml of methanol had been added, the reaction mixture was heated and stirred for 30 minutes, and cooled. The precipitate formed was filtered off, washed well with ethyl acetate, and recrystallized from methanol to obtain 27 g of orange-red crystals.

An aqueous solution of the dye obtained had an orange color, and showed an absorption maximum at 498 mμ.

PREPARATION EXAMPLE 3

(Dye No. 5)

Into a solution of 15 ml of piperidine and 90 ml of methanol was dissolved 25 g of 3-carboxy-1-sulfopropyl-5-pyrazolone with heating to 50° C. A solution of 27 g of 4-(N-methyl-N-sulfoethyl)amino-2-methylbenzaldehyde in 100 ml of methanol was added to the resulting solution. After the addition of 20 ml of acetic acid, the reaction mixture was heated under reflux for 3 hours with stirring. Then, a solution of 10 g of potassium acetate in 80 ml of methanol was added, and the resulting mixture was stirred for another 30 minutes. After cooling, the crystals precipitated were filtered, washed well with ethyl acetate, and recrystallized from a methanol-water mixture to obtain 13 g of orange-red crystals.

An aqueous solution of the dye obtained had an orange-red color, and showed an maximum absorption at 524 mμ.

PREPARATION EXAMPLE 4

(Dye No. 6)

Into 40 ml of methanol was dispersed 2.3 g of 3-carboxy-1-(2-hydroxy-3-sulfopropyl)-5-pyrazolone. To this dispersion was added a solution of 2.9 g of 4-(N-ethyl-N-ethylsulfonylaminoethyl)amino-2-methylcinnamaldehyde in 30 ml of methanol. After 7 ml of glacial acetic acid had been added, the resulting mixture was heated under reflux for 1 hour on a steam bath, and then 5 ml of an aqueous solution of 1.4 g of sodium acetate (trihydrate) was added. The resulting mixture was heated under reflux for 5 minutes, and cooled on an ice bath. The dark-black crystals precipitated were filtered, washed with ethanol and acetone, and dried. Two grams of purplish red crystals were obtained.

An aqueous solution of the dye had a purplish red color, and an absorption maximum at 606 mμ.

PREPARATION EXAMPLE 5

(Dye No. 12)

Into 50 ml of methanol and 8 ml of acetic acid were added 36 g of the triethylamine salt of 4-isopropyl-3-methyl-1-sulfopropyl-5-hydroxypyrazole and 20 ml of 4-N,N-diethylamino-2-methylbenzaldehyde, and the resulting mixture was heated under reflux for 1.5 hours with stirring. The reaction solution changed from orange-red to purplish-red. A solution of 10 g of potassium acetate in 40 ml of methanol was added, and after 5 minutes the mixture was cooled. The precipitated crystals were collected, washed well with ethanol, and dried to obtain 12 g of purplish-red crystals.

An aqueous solution of the dye had an absorption maximum at 575 mμ.

The photographic light-sensitive materials of this invention comprise at least one silver halide photographic emulsion layer coated on a support with at least one of the hydrophilic colloid layers in the photographic materials containing at least one of the dyes represented by the above-described general formula (I).

In the light-sensitive materials of this invention, the dyes of the general formula (I) can be incorporated into either a silver halide photographic emulsion layer or layers, or one of the light-insensitive layers made up of one or more hydrophilic colloids. The light-insensitive layer or layers containing one or more of the dyes can be positioned farther from the support than the other emulsion layer or layers, between the support and an emulsion layer, between two emulsion layers where a plurality of emulsion layers is present, or on the surface of the support opposite the emulsion layer or emulsion layers. The amount of dyes of the general formula (I) employed in the layers can be varied over wide range, depending on the optical density desired for the layer. In general, a range of about 8 to about 200 mg per $m^2$ of the support is suitable.

The dyed light-insensitive layers can function as a filter layer, an antihalation layer, etc., according to the position where they are arranged.

The light-sensitive materials of the invention may contain either a single emulsion layer or a plurality of emulsion layers, and either a single dyed light-sensitive or light-insensitive hydrophilic colloid layer or a plurality of dyed light-sensitive or light-insensitive hydrophilic colloid layers.

The hydrophilic colloids which can be used in the light-sensitive materials of the invention can be not only gelatin (either lime- or acid-processed) but also can be gelatin derivatives, such as those obtained by the reaction of gelatin with aromatic sulfonyl chlorides, acid chlorides, isocyanates or 1,4-diketones as described in U.S. Pat. No. 2,614,928; those obtained by the reaction of gelatin with trimellitic acid anhydride as described in U.S. Pat. No. 3,118,766; those obtained by the reaction of gelatin with reactive halogen-containing organic acids as described in Japanese patent publication No. 5514/64; those obtained by the reaction of gelatin with organic glycidyl ethers as described in Japanese patent publication No. 26845/67; those obtained from the reaction of gelatin with maleimide, maleamic acid, unsaturated aliphatic diamides, etc., as described in U.S. Pat. No. 3,186,846; sulfoalkylated gelatins as described in British Pat. No. 1,033,189; polyoxyalkylene derivatives of gelatin as described in U.S. Pat. No. 3,312,553; and polymer grafted gelatin, for example, those obtained by grafting to gelatin acrylic acid, methacrylic acid or the esters thereof with mono- or poly-hydric alcohols, acrylamide, methacrylamide, acrylonitrile, methacrylonitrile, styrene, or vinyl monomers, individually or in combination; as well as synthetic high molecular weight materials such as homopolymers or copolymers derived from vinyl alcohol, N-vinylpyrrolidone, hydroxyalkylacrylates, hydroxyalkylmethacrylates, acrylamide, methacrylamide, N-substituted acrylamides, N-substituted methacrylamides, etc., copolymers of one of these monomers with acrylic acid esters, methacrylic acid esters, vinyl acetate, styrene, etc., or copolymers obtained from any of the monomers described above and maleic anhydride, maleinamide, etc.; and naturally-occurring hydrophilic polymers other than gelatin, such as casein, agar-agar, alginic acid, polysaccharides, and the like. These hydrophilic colloids can be employed either individually or in combination.

The dyes can be incorporated into hydrophilic colloid layers in the photographic light-sensitive materials of the invention using any conventional method. That is, where a photographic emulsion is dyed, an aqueous solution of the dyes with an appropriate concentration can be added to a silver halide photographic emulsion before coating, or where a light-insensitive layer is dyed, an aqueous solution of the dyes can be incorporated into a solution of a hydrophilic colloid, and then the resulting solution can be coated using known procedures onto a support or an appropriate photographic layer. The amount of the dyes employed can be varied depending on the particular requirements according to the uses of the photographic light-sensitive materials. The amount of the dyes employed can be easily determined using conventional techniques commonly employed by those skilled in the art, that is, the dye content required to obtain a desired absorption density in a hydrophilic colloid layer with an expected thickness can being approximately estimated based on the relation between the concentration of the dye in solution and the spectral absorption of the dye. That is, several layers are experimentally coated with each of the layers containing the dye in a different amount around the estimated amount, the spectral absorption of the layers is determined, and then the amount of the dye to be employed is determined according to the results obtained above.

The present invention is particularly useful for photographic materials in which paper is used as a support. However, this invention is also useful for other light-sensitive materials because photographic papers and photographic films, or photographic papers and photographic plates are often processed in the same photographic processing solution simultaneously or one after another.

In addition to papers, any transparent or opaque, flexible or rigid supports which are commonly used for photographic elements can be employed in the practice of the invention. Examples of suitable supports include synthetic papers of, for example, polystyrene; films of cellulose derivatives such as cellulose nitrate, cellulose acetate, cellulose acetate butyrate, and the like; films of polystyrene, polyvinyl chloride, partially formulated polyvinyl alcohol, polyesters such as polycarbonate or polyethylene terephthalate; polyamide films; polymer plates of polymers such as polyalkylmethacrylates; glass plates; ceramics; metals; and the like. Also, the photographic light-sensitive materials of the invention can comprise a paper support coated with a polymer such as a polyolefin.

The hydrophilic colloid layers containing the dyes of the invention can be coated using various coating procedures including dip coating (including the use of an air knife in combination), curtain coating, extrusion coating (including the use of a combination of hoppers as described in U.S. Pat. No. 2,681,294), etc. If desired, two or more layers can be coated simultaneously using the procedures as described in U.S. Pat. Nos. 2,761,791 and 2,941,898.

The emulsion layers and other hydrophilic colloid layers of the invention can contain, in addition to the dyes according to the invention, any other previously known water-soluble dyes within the limits that the effects of the invention are not substantially impaired. In particular, two or more layers can be advantageously used where the desired spectral absorption properties can not be sufficiently achieved by use of a single dye. Examples of dyes which can be used in combination with the dyes of the invention include the oxonol dyes as described in Japanese patent application (OPI) No. 5125/74 and U.S. Pat. Nos. 3,427,127 and 3,653,905; hemioxonol dyes as described in U.S. Pat. No. 3,687,670; and the like. Alkali soluble pigments such as manganese dioxide and bleachable pigments such as colloidal silver can also be employed in combination with the dyes of the invention, if desired.

The layers that are dyed in accordance with the invention can also contain a polymeric mordant in combination with a hydrophilic colloid. Examples of suitable mordants which can be used in the invention include polymers derived from a ethylenically unsaturated compound containing a dialkyl ester residue as described in British Pat. No. 685,475, or copolymers thereof as described in U.S. Pat. No. 2,839,401; copolymers of maleic anhydride or derivatives thereof as described in British Pat. No. 906,083; polymers obtained by the reaction of a polyvinyl alkyl ketone with aminoguanidine as described in British Pat. No. 850,281; polymers that contain 2-methylimidazole nuclei in the side chains thereof, as described in U.S. Pat. No. 3,445,231; addition polymers of bisacrylamide with a secondary diamine or the quaternary salts thereof as described in Japanese patent application (OPI) No. 24733/73; ternary or quaternary copolymers comprising polyvinyl pyridine or polyvinyl quinoline as described in British Pat. Nos. 765,520 and 766,202; polymers as described in German patent application (OLS) Nos. 1,914,361 and 1,914,362; and other polymers previously known as mordants for acidic dyes suitable for photographic light-sensitive materials.

The hydrophilic colloid layers containing the dyes in accordance with the invention can contain a variety of additives which possess various functions for improving the quality of the photographic light-sensitive materials, such as hardeners, coating aids, plasticizers, lubricants, matting agents, emulsion polymerization latexes, anti-static agents, UV absorbers, anti-oxidants, etc., in addition to the hydrophilic colloids, dyes, pigments and mordants described above. These additives are described in detail below.

The hydrophilic colloid layers including photographic emulsion layers in the light-sensitive materials of the invention can be hardened using conventional hardeners, individually or in combination, such as aldehydes, e.g., glyoxal as described in U.S. Pat. No. 1,870,354 and glutaraldehyde as described in British Pat. No. 825,544; N-methylol compounds such as N,N'-dimethylol urea or dimethylol hydantoin as described in British Pat. No. 676,628; dioxane derivatives such as dihydroxydioxane as described in U.S. Pat. No. 3,380,829 or those described in Japanese patent publication No. 38713/71; epoxy group-containing compounds such as those described in U.S. Pat. Nos. 3,047,394 and 3,091,537 and Japanese patent publication No. 7133/59; reactive halogen-containing compounds such as 2,4-dichloro-6-hydroxy-1,3,5-triazine as described in U.S. Pat. No. 3,325,287; mucohalic acids such as mucochloric acid and mucobromic acid as described in U.S. Pat. No. 2,080,019 or derivatives thereof as described in Japanese patent publication No. 1872/71; bis(methanesulfonic acid esters) as described in U.S. Pat. No. 2,726,162; sulfonyl compounds such as bisbenzenesulfonylchloride as described in U.S. Pat. No. 2,725,295; aziridine compounds such as those described in Japanese patent publication Nos. 4212/58 and 8790/62; diphenyl sulfones such as those described in U.S. Pat. No. 2,579,871; reactive olefinic group-containing compounds such as divinyl ketone as described in German Pat. No. 872,153 and acryloyl group-containing compounds as described in U.S. Pat. Nos. 3,255,000 and 3,635,718; British Pat. No. 994,869; and German Pat. No. 1,090,427; alkylene bismaleimides such as those described in U.S. Pat. No. 2,922,109 and the like; isocyanates such as those described in U.S. Pat. No. 3,103,437; carbodiimides such as those described in U.S. Pat. No. 3,100,704; isooxazole derivatives such as those described in U.S. Pat. Nos. 3,321,313 and 3,543,292; chlorinated carbamoyl derivatives such as those described in Japanese patent publication No. 6899/66; polymeric hardeners such as dialdehyde starch as described in U.S. Pat. No. 3,057,723 or those described in Japanese patent publication No. 12550/67; and inorganic hardeners such as chrome alum, chrome acetate, zirconium sulfate, etc.

The hydrophilic colloid layers, including the photographic emulsion layers in the light-sensitive materials of the invention can contain as a coating aid, an antistatic agent, a lubricant, etc., a variety of surface active agents, such as nonionic surface active agents, e.g., saponin, polyethylene glycol, polyethylene glycol-polypropylene glycol as described in U.S. Pat. No. 3,294,540, polyalkylene glycol ethers as described in U.S. Pat. Nos. 2,240,472 and 2,831,766, polyalkylene glycol esters, polyalkylene glycol amides, and the like; anionic surface active agents, e.g., alkylcarboxylates, alkylsulfonates, alkylbenzenesulfonates, alkylnaphthalenesulfonates, alkylsulfuric acid esters, N-acylated N-alkyl-taurines as described in U.S. Pat. No. 2,739,891, maleopimelates as described in U.S. Pat. Nos. 2,359,980, 2,409,930 and 2,447,750, and those described in U.S. Pat. Nos. 2,823,123 and 3,415,649; amphoteric surface active agents such as those described in British Pat. No. 1,159,825, Japanese patent publication No. 378/65, Japanese patent application (OPI) No. 43924/72 and U.S. Pat. No. 3,726,683.

The hydrophilic colloid layers in the light-sensitive materials of the invention can contain lubricants, such as higher alcohol esters of higher fatty acids as described in U.S. Pat. Nos. 2,588,756 and 3,121,060; caseins as described in U.S. Pat. No. 3,295,979; calcium salts of higher fatty acids as described in British Pat. No. 1,263,722; silicone compounds as described in British Pat. No. 1,313,384 and U.S. Pat. Nos. 3,042,522 and 3,489,567; and the like. Dispersions of liquid paraffin can also be employed for this purpose.

The hydrophilic colloid layers, including the photographic emulsion layers in the light-sensitive materials of the invention, can contain plasticizers, such as glycerol; diols as described in U.S. Pat. No. 2,960,404; trihydric fatty alcohols as described in U.S. Pat. No. 3,520,694; and the like.

The hydrophilic colloid layers including the photographic emulsion layers in the light-sensitive materials of the invention can contain dispersions of synthetic polymers which are insoluble or slightly soluble in water for the purpose of increasing the dimensional stability and the like. Examples of such polymers include those containing as monomer components alkylacrylates, alkylmethacrylates, alkoxyacrylates, alkoxymethacrylates, glycidylacrylates, glycidylmethacrylates, vinyl acetate, acrylonitrile, olefins, styrene, etc., individually or in combination, or those containing as monomer components a combination of at least one of the monomers described above and at least one monomer selected from acrylic acid, acrylamide, $\alpha,\beta$-unsaturated dicarboxylic acids, sulfoalkylacrylates, styrene sulfonic acid, etc., including those described in U.S. Pat. Nos. 2,376,005, 3,607,290 and 3,645,740; British Pat. Nos. 1,186,699 and 1,307,373; and U.S. Pat. Nos. 3,062,674, 2,739,137, 3,411,911, 3,488,708, 3,635,715 and 2,853,457.

The hydrophilic colloid layers in the light-sensitive materials of the invention can contain matting agents, such as inorganic particles, e.g., silica as described in Swiss Pat. No. 330,158; glass powder as described in French Pat. No. 1,296,995; carbonates of alkaline earth metals, cadmium, zinc, etc., as described in British Pat. No. 1,173,181; and organic particles, e.g., starch powder as described in U.S. Pat. No. 2,322,037; starch derivatives as described in Belgian Pat. No. 625,451 or British Pat. No. 981,198; polyvinyl alcohol as described in Japanese patent publication No. 3,643/69; polystyrene or polymethyl methacrylate as described in Swiss Pat. No. 330,158; polyacrylonitrile as described in U.S. Pat. No. 3,097,257; and polycarbonates as described in U.S. Pat. No. 3,022,169.

The hydrophilic colloid layers including the photographic emulsion layers in the light-sensitive materials of the invention can contain UV absorbers, such as the benzophenones, benzotriazoles, thiazolines, etc. These UV absorbers can be mordanted in a particular layer in a similar manner as the dyes.

The photographic emulsion layers and other hydrophilic colloid layers in the light-sensitive materials of the invention can contain brighteners, such as stilbenes, triazines, oxazoles, or coumarins. The water-soluble brighteners can be used as solutions thereof and the water-insoluble brighteners can be used in the form of a dispersion thereof.

The hydrophilic colloid layers in the light-sensitive materials of the invention can contain additives which are used for the purpose of the prevention of color stain or color contamination between adjacent layers in color light-sensitive materials, such as alkylhydroquinones, dialkylhydroquinones, aryl-substituted hydroquinones, sulfo-substituted hydroquinones, polymeric compounds containing hydroquinone residues, catechol derivatives, aminophenol derivatives, gallic acid derivatives, ascorbic acids, etc., if desired, in the form of a dispersion. Examples of such compounds are described in, for example, British Pat. Nos. 557,750 and 557,802; U.S. Pat. Nos. 2,336,327, 2,360,290, 2,403,721, 2,728,,659, 2,732,300, 2,735,765, 2,418,613, 2,675,314, 2,710,801, 2,816,028 and 2,360,290; French Pat. No. 885,982; U.S. Pat. Nos. 2,336,327 and 2,403,721; British Pat. No. 1,133,500; Japanese patent publication No. 13496/68; and U.S. Pat. Nos. 3,457,079, 2,360,290 and 2,384,658. These compounds can be incorporated into the hydrophilic colloid layers by dispersing the compounds into hydrophilic colloids together with organic solvents having high boiling points, such as aliphatic esters, aromatic carboxylic acids alkyl esters, aromatic phosphoric acid esters, aromatic ethers, etc., or by incorporating the compound into hydrophilic colloids in the form of an aqueous alkaline solution thereof.

The silver halide photographic emulsions used in this invention can be prepared by a variety of previously known procedures, to achieve appropriate properties for their end use.

The silver halides which can be used in the invention include silver chloride, silver chlorobromide, silver bromide, silver iodobromide, silver iodochlorobromide, etc. The halogen composition is not particularly limited. As a protective colloid used upon formation of silver halide grains, these may be used. In addition to gelatin, which is commonly used, gelatin derivatives such as phthalated gelatin, acylated gelatin, e.g., succinoylated gelatin, grafted gelatin such as those grafted with acrylamide, hydroxyalkyl(meth)acrylamide, etc.; synthetic polymers such as those of three monomers comprising acrylic acid (or methacrylic acid), acrylamide (or methacrylamide) and the amine derivatives thereof (e.g., N-(dialkylaminoalkyl)acrylamide); individually or in combination.

The silver halide emulsions can be prepared by any known procedures, such as those described in C. E. K. Mees & T. H. James, *The Theory of the Photographic Process*, 3rd Ed., Macmillan Co., New York (1966); P. Grafkides, *Chemie Photographique*, 2nd Ed., Photocinema, Paul Montel, Paris (1957); H. Frieser, *Die Grundlagen der Photographische Prozesse mit Silverhaligeniden*, Vol. 2, pp. 609 – 674 and pp. 735 – 743, Akademische Verlagsgesellschaft, Frankfurt-am-Main, (1968); and the like; including using an acidic process, a neutral process or an ammoniacal process, as well as a single jet process or double jet (or twin jet) process. If desired, the so-called controlled double jet method as described in *Berichte der Bunsengesellschaft fuer Physickalische Chemie*, Band 67, 349 (1963) can also be used. This method is especially advantageous for obtaining emulsions with an extremely narrow grain size distribution.

The silver halide grains can be in a cubic, octahedral, or tetradecahedral form or a twin form due to the coexistence of these forms, or mixtures thereof. The silver halide emulsions can be coarse or fine grain. Mean values (arithmetrical mean values determined by the projection method) of the diameter or the edge of the grains (or other value indicating the corresponding grain size) can be less than about 0.2 $\mu$, from about 0.2 to 1 $\mu$, or more than about 1 $\mu$. The distribution of the grain size (which has the same meaning as described above) can be either narrow or broad.

The silver halide emulsions can be unripened or ripened physically. A well known noodle washing procedure or flocculation procedure using inorganic salts containing polyvalent anions (e.g., ammonium sulfate), anionic surfactants, anionic polymers such as polystyrene sulfate, etc., or gelatin derivatives such as acylated gelatin can be used for removing soluble salts from the emulsions after precipitation and physical ripening.

The silver halide emulsions can be unsensitized or can be chemically sensitized. The emulsions can be chemically sensitized using, individually or in combination, any of the well known methods, including those described in Mees & James, supra, Grafkides, supra, or Frieser, supra, that is, such as sulfur sensitization using compounds containing sulfur capable of reacting with silver ion, e.g., thiosulfate or those described in U.S. Pat. Nos. 1,574,944, 2,278,947, 2,410,689, 3,189,458 and 3,501,313; and French Pat. No 2,059,245; or active gelatin; by reduction sensitization using reducing materials, such as stannous salts as described in U.S. Pat. No. 2,487,850; amines such as those described in U.S. Pat. Nos. 2,518,698, 2,521,925, 2,521,926, 2,419,937 and 2,419,975; iminoaminomethane-sulfinates such as those described in U.S. Pat. No. 2,983,610; silanes as described in U.S. Pat. No. 2,694,637; or those described in H. W. Wood, *Journal of Photographic Science*, Vol. 1 163 (1953); gold sensitization using gold complexes or gold-thiosulfate complex as described in U.S. Pat. No. 2,399,083; or by using salts of noble metals such as platinum, iridium, rhodium or ruthenium, such as those described in U.S. Pat. Nos. 2,448,060, 2,540,086, 2,566,247 and 2,566,263. Selenium sensitization as described in U.S. Pat. No. 3,297,446 can also be used in place of or in combination with sulfur sensitization.

The silver halide emulsions used in the invention can be spectrally sensitized to blue light having a longer wavelength, green light and red light or to infra red region of the spectrum using any of the known sensitizing dyes, such as cyanine dyes, merocyanine dyes, complex cyanine dyes, complex merocyanine dyes, holopolar cyanine dyes, styryl dyes, hemicyanine dyes, oxonol dyes, hemioxonol dyes, and the like. The cyanine dyes can optionally contain heterocyclic rings, such as pyrrolines, oxazolines, thiazolones, pyroles, oxazoles, thiazoles, selenazoles, imidazoles or pyridines as basic nuclei. These nuclei can be optionally substituted with an alkyl group, an alkylene group, a hydroxyalkyl group, a carboxyalkyl group, a sulfoalkyl group, an aminoalkyl group, an alkoxyalkyl group, a sulfohydroxyalkyl group, a sulfoalkoxyalkyl group, and the like. The nuclei can be condensed with one or more hydrocarbon or heterocyclic rings which can be optionally substituted with a halogen atom, an alkyl group, an alkoxy group, a hydroxy group, a cyano group, a carboxy group, an alkoxycarbonyl group, an alkylamino group, a dialkylamino group, an acylamino group, a phenyl group or a fluoroalkyl group. The cyanine dyes can be either symmetrical or asymmetrical, and can be substituted with an alkyl group, a phenyl group, a substituted phenyl group such as a carboxyphenyl group, an isophorone nucleus, or a heterocyclic ring. The merocyanine dyes used can be those containing a basic nucleus described above and an acidic nucleus such as a 2-thiaoxazolidinedione ring, a rhodanine ring, a thiohydantoin ring, a barbituric acid ring, a thiobarbituric acid ring or a ring contaning $$-\mathrm{COCH}\underset{\underset{\mathrm{A}}{|}}{\mathrm{C}}\mathrm{N}$$

group (wherein A represent an electron attracting group). The above acidic nucleui can be optionally substituted with an alkyl group, an alkylene group, a phenyl group, a hydroxyalkyl group, a carboxyalkyl group, a sulfoalkyl group, an alkoxyalkyl group, an acylamino group or a heterocyclic group. These sensitizing dyes can be employed either individually or in combination. A large number of combinations of sensitizing dyes are known, and are used for the purpose of supersensitization.

The photographic emulsions can contain materials which give rise to supersensitizing effects without absorbing a substantial amount of visual light, such as pyrimidinylamino group-containing or triazinylamino group-containing compounds such as those described in U.S. Pat. Nos. 2,933,390, 3,511,664, 3,615,613, 3,615,632 and 3,615,641; aromatic organic acid-formaldehyde condensation products as described in British Pat. No. 1,137,580; azaindenes; or cadmium salts.

The photographic emulsions in the light-sensitive materials of the invention can contain various compounds for the purpose of the prevention of fogging or the stabilization of the photographic properties during preparation, storage or processing of the materials. Examples of such compounds include triazoles, such as benzotriazole, benzthiazolium salts as described in U.S. Pat. No. 2,131,038, aminobenzimidazoles as described in U.S. Pat. No. 2,324,123, etc.; nitroazoles, such as nitroindazoles, nitrobenztriazoles, nitrobenzimidazoles as described in British Pat. 403,789 and nitroaminobenzimidazoles as described in U.S. Pat. 2,324,123; halogen-substituted azoles, such as 5-chlorobenzimidazole, 5-bromoimidazole or 6-chlorobenzimidazole; mercaptoazoles, such as mercaptothiazole derivatives as described in U. S. Pat. No. 2,824,001; mercaptobenzthiazoles, derivatives of these compounds as described in U.S. Pat. No. 2,697,099; mercaptoimidazole derivatives as described in U.S. Pat. No. 3,252,799; mercaptobenzimidazoles, mercaptooxadiazoles as described in U.S. Pat. No 2,843,491; mercaptothiadiazoles as described in U.S. Pat. No. 1,758,576; phenylmercaptotetrazoles as described in U.S. Pat. No. 2,403,927; mecaptopyrimidines such as those described in U.S. Pat. No. 2,304,962; mercaptotriazines as described in U.S. Pat. No. 2,476,536; mercaptotetrazaindenes as described in U.S. Pat. No. 3,226,231; thiosalicyclic acids as described in U.S. Pat. No. 2,377,375; thiobenzoic acids as described in U.S. Pat. No. 3,226,231; sugar mercaptals as described in Japanese patent publication No. 8743/72; oxazolinethiones as described in U.S. Pat. No. 3,251,691; and triazolodiazoles as described in Japanese patent publication No. 17932/68; as well as azaindenes, for example, tetrazaindenes such as those described in U.S. Pat. Nos. 2,444,605, 2,444,606 and 2,450,397 and Japanese patent publication Nos. 10166/64 and 10516/67; pentazaindene compounds such as those described in U.S. Pat. No. 2,713,541 and Japanese patent publication No. 13495/68; or nitrogen-containing heterocyclic compounds capable of preventing fogging, such as urazoles described in U.S. Pat. No. 2,708,161; and in addition, benzenesulfinic acids and benzenethiosulfonic acids as described in U.S. Pat. No. 2,394,198; and benzenesulfinamides as described in Japanese patent publication No. 4136/68. The hydrophilic colloid layers can also contain various chelating agents, such as those described in U.S. Pat. No. 2,691,588; British patent No. 623,488; and Japanese patent publication Nos. 4941/68 and 13496/72, which are used for the purpose of the prevention of fogging due to metal ions.

The photographic emulsion layers and other hydrophilic colloid layers in the light-sensitive materials of the invention can also contain various additives, which are used for the purpose of improvement of sensitivity increasing the contrast or promotion of development, such as polyalkylene oxide derivatives, for example, polyalkylene oxides as described in U.S. Pat. No. 2,441,389; ethers, esters and amides of polyalkylene oxides are described in U.S. Pat. No. 2,708,161; and those as described in British Pat. No. 1,145,186 and Japanese patent publication Nos. 10989/70, 15188/70, 43435/71, 8106/72 and 8742/72, thioethers as described in U.S. Pat. Nos. 3,046,132, 3,046,133, 3,046,134 and 3,046,135 or Japanese patent publication Nos. 9019/70 and 11119/72; thiomorpholines as described in Japanese patent publication No. 28325/72; quaternary ammonium compounds as described in U.S. Pat. No. 3,722,021; pyrrolidines as described in Japanese patent publication No. 27037/70; urethanes or urea derivatives as described in Japanese patent publication No. 23465/65; imidazole derivatives as described in Japanese patent publication No. 45541/72; polymers as described in Japanese patent publication No. 26471/70; 3-pyrazolidones as described in Japanese patent publication No. 27670/70.

For the purpose of sensitization or prevention of fogging, the photographic emulsions used in the light-sensitive materials of the invention can contain inorganic or organic mercury compounds, such as mercury complexes as described in U.S. Pat. No. 2,728,664; benzthiazole mercury salts as described in U.S. Pat. No. 2,728,667; addition products of mercury salts, such as those described in U.S. Pat. Nos. 2,728,663 and 2,732,302; and organic mercury compounds as described in U.S. Pat. Nos. 2,728,665 and 3,420,668.

Where silver halide photographic emulsions having particularly small grain sizes (e.g., less than about 0.4 $\mu$ or less than about 0.2 $\mu$), are employed in the light-sensitive materials of the invention, sensitizers such as those described in British Pat. Nos. 1,316,493, 1,317,138, 1,317,139, 1,317,709 and 1,297,901 and German patent application (OLS) No. 2,235,031 can be employed.

The photographic emulsion layers in the photographic light-sensitive materials of the invention can also contain conventional non-diffusible color image-forming couplers The term "color image-forming coupler" designates a compound capable of forming dyes by the reaction with the oxidation products of aromatic primary amine developers upon photographic processing (hereinafter referred to merely "couplers"). The couplers used can be either 4- or 2-equivalent couplers. They can also be colored couplers for color correction, or a development inhibitor-releasing coupler. Examples of useful yellow, magenta or cyan color-forming couplers include, respectively, open-chained ketomethylene compounds such as acylaminoacetamides, pyrazolone or cyanoacetyl compounds, and naphthol or phenol compounds. The couplers can be incorporated into photographic emulsions using any procedures which are generally employed for the production of multi-color light-sensitive materials.

Suitable examples of yellow color forming couplers which can be used are described in, for example, U.S. Pat. Nos. 2,875,057, 3,265,506, 3,341,331, 3,369,895, 3,408,194, 3,551,155, 3,582,322, 3,725,072; West German Pat. DAS No. 1,547,868; West German patent application (OLS) Nos. 2,057,941, 2,162,899, 2,213,461, 2,219,917, 2,261,361 and 2,263,875.

Suitable examples of magneta color forming couplers which can be used are described in, for example, U.S. Pat. Nos. 2,439,098, 2,600,788, 2,983,608, 3,311,476, 3,419,391, 3,519,429, 3,558,319, 3,582,322, 3,615,506; British Pat. No. 956,261; West German Pat. No 1,810,464; West German patent application (OLS) Nos. 2,408,665, 2,418,959, 2,424,467 and Japanese patent publication No. 2016/69.

Suitable examples of cyan color forming couplers which can be used are described in, for example, U.S. Pat. Nos. 2,369,924, 2,434,272, 2,474,293, 2,698,794, 2,706,684, 2,895,826, 3,034,892, 3,311,476, 3,386,301, 3,458,315, 3,560,212, 3,582,322, 3,583,971, 3,591,383; West German patent application (OLS) Nos. 2,163,811, 2,414,006; and Japanese patent publication No. 28836/70.

Also, so-called development inhibitor-releasing (DIR) couplers capable of releasing a compound inhibiting development during color formation and/or a compound capable of releasing a compound inhibiting development during development may be added. Suitable examples of these couplers are described in, for example, U.S. Pat. Nos. 3,148,062, 3,227,554, 3,253,924, 3,297,445, 3,379,529, 3,617,291, 3,622,328, 3,639,417, 3,705,201; British Pat. No. 1,201,110; West German patent application (OLS) Nos. 2,414,006, 2,417,914.

The present invention can be applied to multi-layer multi-color photographic materials containing on a support at least two emulsion layers having different spectral sensitivities. Usually, multi-layered natural color photographic materials comprise, coated on the support, at least one red-sensitive silver halide emulsion layer, at least one green-sensitive silver halide emulsion layer and at least one blue-sensitive silver halide emulsion layer. The order of these layers can be arbitrarily selected in accordance with requirements of the photographic material. Usually, cyan-forming couplers are present in the red-sensitive silver halide emulsion layers, magenta-forming couplers are present in the green-sensitive silver halide emulsion layers, and yellow-forming couplers are present in the blue-sensitive silver halide emulsion layers. However, this combination can be altered, if desired.

The hydrophilic colloid layers, including photographic emulsion layers, in the light-sensitive materials of the invention can contain developers, such as aromatic diols (e.g., hydroquinone), aminophenols, phenylenediamines, 3-pyrazolidones, or ascorbic acid or derivatives thereof, individually or in combination. The combination of hydroquinone and the N-hydroxyalkyl-substituted p-aminophenol derivatives as described in Japanese patent publication No. 43814/48 is particularly advantageous. Where water-insoluble developers are used, these developers can be incorporated into the emulsions in the form of a dispersion thereof.

The light-sensitive materials of the invention can have an antistatic or electrically conductive layer, such as an evaporated or electrodeposited metal layer or a layer comprising an ionic polymer.

The light-sensitive materials of the invention can be processed using known procedures. Any of the known processing solutions can be used for their processing. The processing temperature may be lower than about 18° C, between about 18° C and about 50° C, or higher than about 50° C.

The light-sensitive materials of the invention can be processed using either processing procedures for forming silver images (black-and-white photographic processing) or color processing procedures comprising a color developing step for forming dye images.

In black-and-white processing of the light-sensitive materials of the invention, any of the known developing solutions containing previously known developing agents, such as dihydroxybenzenes (e.g., hydroquinone, chlorohydroquinone, bromohydroquinone, 2,3-dichlorohydroquinone, methylhydroquinone, isopropylhydroquinone, 2,5-dimethylhydroquinone, etc.), 3-pyrazolidones (e.g., 1-phenyl-3-pyrazolidone, 1-phenyl-4-methyl-3-pyrazolidone, 1-phenyl-4,4-dimethyl-3-pyrazolidone, 1-phenyl-4-ethyl-3-pyrazolidone, 1-phenyl-5-methyl-3-pyrazolidone, etc.), aminophenols (e.g., o-aminophenol, p-aminophenol, N-methyl-p-aminophenol, 2,4-diaminophenol, etc.), pyrogallol, ascorbic acid, 1-aryl-3-pyrazolines (e.g., 1-(p-hydroxyphenyl)-3-aminopyrazoline, 1-(p-methylaminophenyl)-3-aminopyrazoline, 1-(p-aminophenyl)-3-aminopyrazoline, 1-(p-amino-m-methylphenyl)-3-aminopyrazoline, etc.), and the like, individually or in combination can be used. I desired, the developing solutions can additionally contain preservatives (e.g., sulfites, bisulfites, ascorbic acid, etc.), alkaline agents (e.g., hydroxides, carbonates, etc.), buffers (e.g, carbonates, borates, boric acid, acetic acid, citric acid, alkanolamines, etc.), solublizing aids (e.g., polyethylene glycols and the esters thereof, alkanolamines, etc.), sensitizing agents (e.g., nonionic surfactants containing a polyoxyethylene chain, quaternary ammonium compounds, etc.), surface active agents, defoaming agents, antifoggants (e.g., alkali metal halides such as potassium bromide and sodium bromide, nitrobenzimidazoles, nitrobenzoindazoles, benztriazoles, benzthiazoles, tetrazoles, thiazoles, etc.), chelating agents (e.g., ethylenediaminetetraacetic or the alkali metal salts thereof, nitrilotriacetates, polyphosphates, etc.), development promoters (e.g., those described in U.S. Pat. No. 2,304,025 and Japanese patent publication No. 45541/72), hardeners (e.g., glutaraldehyde, etc.), and the like.

The light-sensitive materials of the invention can also be processed using a so-called lith-type processing. A lith-type processing is a processing in which the developing step is effected infectiously at a low sulfite ion concentration by using, as the developing agent, dihydroxybenzenes for the purpose of photographic reproduction of line images of dot half tone images. Further details of lith-type processing are disclosed in Mason, *Photographic Processing Chemistry*, pp. 163 – 165 (1966).

The light-sensitive materials of the invention are also suitable for lith-type processing since the dyes of the invention can be readily decolored at low sulfite concentrations.

As a special form of processing, the light-sensitive materials of the invention can be processed in a aqueous alkaline solution by incorporating developing agents into the emulsion layers. In many cases, such a processing is utilized as a rapid processing method for light-sensitive materials, by using the processing in combination with silver salt stabilizing treatment employing thiocyanates. The light-sensitive materials of the invention can also be employed in such a rapid processing.

The light-sensitive materials of the invention can be fixed using any of the conventional fixing solutions, which generally comprise fixing agents and hardeners, and generally have a pH of from about 3.8 to 5.0. Examples of fixing agents which can be used include thiosulfates such as sodium thiosulfate, potassium thiosulfate, ammonium thiosulfate, etc., thiocyanates such as sodium thiocyanate, potassium thiocyanate, ammonium thiocyanate, etc., as well as organic sulfur compounds capable of forming soluble and stable silver complexes.

Examples of hardeners which are generally incorporated in fixing solutions include water-soluble aluminum salts such as aluminum chloride, aluminum sulfate, potassium alum, and the like.

The light-sensitive materials of the invention can be processed using any of the conventional procedures for forming dye images. For example, they can be processed according to the negative-positive method is described in *Journal of the Society of Motion Picture and Television Engineering*, 61, pp. 667 – 701 (1953); the color reversal method for forming color positive images in which after imagewise exposure a negative silver image is formed by the processing using a developing solution containing a black-and-white developer, and the resulting photographic material is subjected to at least one uniform exposure (or an appropriate fogging treatment) and then color developed; or a method for obtaining positive dye images using a direct positive emulsion.

The light-sensitive materials of the invention can be processed using any of the known color developing solutions. Examples of color developing agents which can be used include primary aromatic amine developing agents such as phenylenediamines (e.g., N,N-diethyl-p-phenylenediamine, N-ethyl-N-(β-hydroxyethyl-)amino-2-methylaniline, 4-(N-ethyl-N-β-methanesulfonamidoethyl)amino-2-methylaniline, N,N-diethylamino-2-ethoxyaniline, etc.) and p-aminophenols (e.g., 4-aminophenol, 2,6-dichloro-4-aminophenol, 2-bromo-4-aminophenol, etc.). The color developing solutions can contain other conventional additives, such as sulfites, carbonates, bisulfites, bromides and iodides of alkali metals, and alkaline buffers. If desired, the color developing solution can also contain dye-forming couplers, competitive couplers, antifoggants, hardeners, antioxidants, thickeners, and the like.

The benzylidene- or cinnamylidene-pyrazolone dyes used in the invention can be distinguished from known benzylidene- or cinnamylidene-pyrazolone dyes by the substituents at the 1-position of the pyrazolone nucleus. That is, the dyes according to the invention are substituted with a sulfoalkyl group, a sulfoalkoxyalkyl group or a sulfoalkylthioalkyl group at the 1-position of the pyrazolone nucleus, whereas previously known water-soluble benzylidene- or cinnamylidene-pyrazolone dyes such as those described in British Pat. Nos. 584,609, 1,120,294 and 1,142,697 and U.S. Pat. Nos. 3,316,091, 3,540,887, 3,544,352 and 3,615,546 are substituted with a sulfo-substituted aryl group at the 1-position of the pyrazolone ring. Based on these differences in structure, the dyes according to this invention possess distinct advantages over previously known dyes. That is, when applied to antihalation layers, filter layers, photographic emulsion layers, etc., of photographic light-sensitive materials, the dyes of the invention diffuse into processing solutions more rapidly than any other known sulfoaryl-substituted pyrazolone dyes and even where paper is employed as the support, the dyes of the invention do not remain on the paper support, which is different from the situation with existing known dyes. Accordingly, a decrease in the sulfite ion concentration due to washing never causes any stain for the photographic light-sensitive materials since no dye remains therein.

The present invention is further illustrated by the following examples.

EXAMPLE 1

To 1000 ml of a silver chlorobromide emulsion having a bromide content of 60 mol%, having a mean grain size of 0.3 $\mu$ and containing 50 g of silver and 75 g of gelatin per 1000 g of emulsion, were added 100 ml of 2% aqueous solution of Dye 1, 2, 5, 7 or 11 described hereinbefore and 20 ml of a 6% aqueous formaldehyde solution. The mixtures thus-obtained were coated onto baryta papers (basis weight: 75 g per $m^2$) at a coverage of 25 mg of silver per 100 $cm^2$ and dried to produce Samples A, B, C, D and E, respectively.

Three Control Samples, X, Y and Z were prepared in a similar manner as above, except that known Dye X:

Dye X

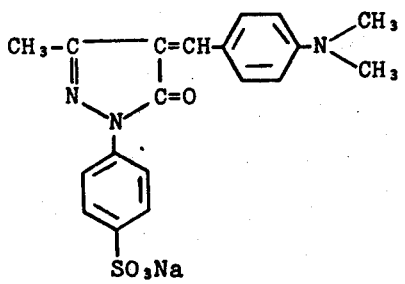

was used for Sample X, known Dye Y:

Dye Y

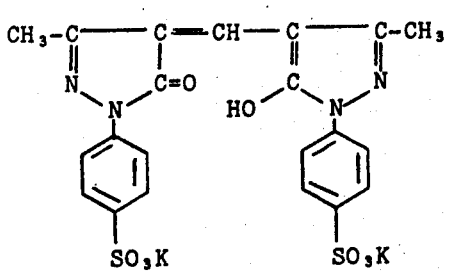

was used for Sample Y and no dye was used in Sample Z in place of the dyes used above.

Twenty-five sheets (21 × 59 cm) were cut from each sample, and they were exposed behind a negative original, one-half of which was transparent and the other half of which had a density of about 2.5. All the sheets were processed successively in 1 l of developing solution and 1 l of fixing solution. The developing solution and the fixing solution had the compositions shown below.

| | |
|---|---|
| Developing Solution: | |
| Metol | 3.1 g |
| Sodium Sulfite (anhydrous) | 45 g |
| Hydroquinone | 12 g |
| Sodium Carbonate (monohydrate) | 79 g |
| Potassium Bromide | 1.9 g |
| Water to make | 1000 ml |
| Fixing Solution: | |
| Sodium Thiosulfate | 160 g |
| Sodium Sulfite (anhydride) | 14 g |
| Acetic Acid | 12 ml |
| Borax | 12 g |
| Potassium Alum | 5 g |
| Water to make | 1000 ml |

The development was carried out for 2 minutes at 20° C, the fixing was carried out for 10 minutes at 20° C, and washing was carried out for 50 minutes using running water. After washing, each of the 25th sheets was dried and color stain was evaluated.

The results obtained were as follows:

| Sample | Dye Used | Color Stain |
|---|---|---|
| A | 1 | None |
| B | 2 | " |
| C | 5 | " |
| D | 7 | " |
| E | 11 | " |
| X | X (Control) | Slightly colored (Light orange) |
| Y | Y (Control) | Slightly colored (Light orange) |
| Z | — | None |

No color stain was observed in the samples containing the dyes of the invention, whereas, in the control samples containing previously known dyes color stain was observed in the processed papers even after a prolonged period of washing.

EXAMPLE 2

To 1000 g of photographic emulsions having the same composition as that described in Example 1 were added 100 ml of 2% aqueous solution of Dye 4, 6 or 12 described hereinbefore and 20 ml of a 6% aqueous solution of formaldehyde. The solutions obtained were coated onto baryta papers (basis weight: 75 g per $m^2$) at a coverage of 25 mg of silver per 100 $cm^2$ to produce Samples F, G and H, respectively.

Control Sample U and V were prepared in the same manner as above, except that known Dye U or V:

Dye U

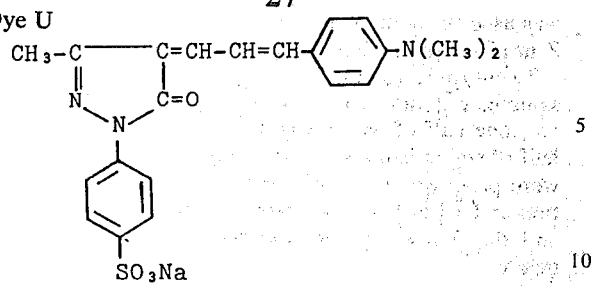

Dye V

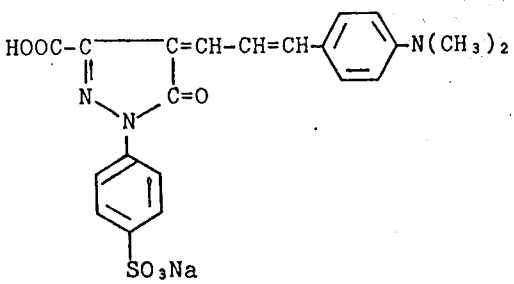

was used in place of the dyes employed above, and Control Sample Z was prepared in a similar manner as above, except that no dye was employed.

From each sample 25 sheets having a size of 21 × 59 cm were cut and the sheets were processed using the same procedures as in Example 1. Color stain on each of the 25th sheets was evaluated/

| Sample | Dye Used | Color Stain |
|---|---|---|
| F | 4 | None |
| G | 6 | " |
| H | 12 | " |
| U | U (Control) | Slightly colored (Pink) |
| V | V (Control) | Slightly colored (Pink) |
| Z | — | None |

In the papers according to the invention, no color stain was observed after processing in contrast to those papers produced according to prior art.

While the invention has been described in detail and with reference to specific embodiments thereof, it will be apparent to one skilled in the art that various changes and modifications can be made therein without departing from the spirit and scope thereof.

What is claimed is:

1. A photographic light-sensitive material containing at least one hydrophilic colloid layer containing at least one dye represented by the following formula (I):

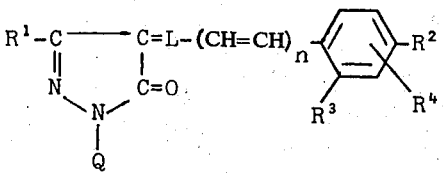

(I)

wherein $R^1$ represents an alkyl group, a carboxy group, an alkoxycarbonyl group, a carbamoyl group, an alkylcarbamoyl group, a sulfamoyl group, an alkylsulfamoyl group, an acyl group, a hydroxy group, an alkoxy group, an alkylthio group, an amino group, a ureido group, an alkylureido group, a thioureido group or an alkylthioureido group; Q represents a sulfoalkyl group, a sulfoalkoxyalkyl group or a sulfoalkylthioalkyl group; L represents a methine group; $n$ is 0 or 1; $R^2$ represents an $-OR^5$ group or an

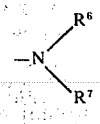

group wherein $R^5$, $R^6$ and $R^7$ each represents a hydrogen atom or an alkyl group; $R^3$ represents a hydroxy group, an alkoxy group or an alkyl group; and $R^4$ represents a hydrogen atom, an alkyl group, an alkoxy group, a sulfoalkoxy group, an alkylamino group or a dialkylamino group.

2. The photographic light-sensitive material of claim 1, wherein said alkyl group for $R^1$ is a straight chain, branched chain or cyclic alkyl group; said acyl group for $R^1$ is an alkylcarbonyl group or an alkylsulfonyl group in which the alkyl moiety thereof may be substituted with one or more of a halogen atom or a cyano group; said amino group for $R^1$ is an amino group, a monoalkylamino group, a dialkylamino group or an acylamino group; said sulfoalkyl group, the sulfoalkoxyalkyl group or the sulfoalkylthioalkyl group for Q may contain 1 or more of a halogen atom, a hydroxy group or an alkoxy group as a substituent in addition to the sulfo group substituent; said methine group for L is an unsubstituted methine group or a methine group substituted with an alkyl group; said alkyl group for $R^5$, $R^6$ and $R^7$ is an unsubstituted alkyl group or an alkyl group substituted with one or more of a cyano group, a sulfo group, a carboxy group, a halogen atom, a hydroxy group, an alkoxycarbonyl group, an alkylcarbonyloxy group, an alkylsulfonyloxy group, an alkylcarbonyl group, an alkylsulfonyl group, an alkoxy group, and a alkylthio group; and said substituted alkyl group for $R^6$ and $R^7$ can be substituted further with one or more of an amino group, an alkylamino group, a dialkylamino group, an alkylcarbonylamino group and alkylsulfonylamino group and wherein said carboxy groups, said sulfo groups and said sulfo moieties of said sulfoalkyl groups, said sulfoalkoxyalkyl groups and said sulfoalkylthioalkyl groups may be a free carboxy or sulfo group or a salt of a carboxy or sulfo group.

3. The photographic light-sensitive material of claim 1, wherein $R^1$ is an alkyl group, a carboxy group, an alkoxycarbonyl group, an alkylcarbamoyl group, a hydroxy group, an alkoxy group, an acylamino group or an alkylureido group; Q is a sulfoalkyl group; L is an unsubstituted methine group; $R^2$ is a hydroxy group, an alkoxy group, a sulfoalkoxy group, an amino group, a dialkylamino group, an N-sulfoalkyl-N-alkylamino group, a di(sulfoalkyl)amino group or an N-(alkylsulfonylaminoalkyl)-N-alkylamino group; $R^3$ is a hydroxy group, a methoxy group or a methyl group; and $R^4$ is a hydrogen atom, a methyl group or a methoxy group.

4. The photographic light-sensitive material of claim 3, wherein $R^2$ is an alkoxy group, a sulfoalkoxy group, a dialkylamino group or an N-sulfoalkyl-N-alkylamino group.

5. The photographic light-sensitive material of claim 1, wherein the dye of formula (I) is present in said photographic light-sensitive material in an amount of about 8 to 200 mg per $m^2$.

6. The photographic light-sensitive material of claim 1, wherein said photographic light-sensitive material comprises a support having thereon at least one silver halide photographic emulsion layer.

7. The photographic light-sensitive material of claim 6, wherein said photographic light-sensitive material includes at least one non-light-sensitive hydrphilic colloid layer.

8. The photographic light-sensitive material of claim 6, wherein said dye having the formula (I) is present in said silver halide photographic emulsion layer.

9. The photographic light-sensitive material of claim 7, wherein said dye having the formula (I) is present in said silver halide photographic emulsion layer.

10. The photographic light-sensitive material of claim 7, wherein said dye of the formula (I) is present in said non-light-sensitive hydrophilic colloid layer.

* * * * *